US007500816B2

(12) United States Patent
Berends et al.

(10) Patent No.: US 7,500,816 B2
(45) Date of Patent: Mar. 10, 2009

(54) SYSTEM WITH LIFTING COLUMNS

(75) Inventors: Jan Berends, Buitenpost (NL); Jean Dell Amore, Stevensville, MD (US); Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 108 days.

(21) Appl. No.: 10/527,717

(22) PCT Filed: Sep. 15, 2003

(86) PCT No.: PCT/NL03/00638

§ 371 (c)(1),
(2), (4) Date: Jan. 9, 2006

(87) PCT Pub. No.: WO2004/024612

PCT Pub. Date: Mar. 25, 2004

(65) Prior Publication Data

US 2006/0115353 A1 Jun. 1, 2006

(30) Foreign Application Priority Data

Sep. 13, 2002 (NL) ..... 1021448

(51) Int. Cl.
*B66F 3/46* (2006.01)

(52) U.S. Cl. ..... 414/458; 187/210

(58) Field of Classification Search ..... 414/458; 187/210

See application file for complete search history.

(56) References Cited

U.S. PATENT DOCUMENTS

| | | | | |
|---|---|---|---|---|
| 3,289,868 | A * | 12/1966 | Miller et al. | 254/45 |
| 4,777,798 | A * | 10/1988 | Jacobson et al. | 60/428 |
| 5,800,114 | A * | 9/1998 | Secondi | 414/458 |
| 6,315,079 | B1 | 11/2001 | Berends et al. | |
| 6,634,461 | B1 * | 10/2003 | Baker | 187/247 |
| 7,219,770 | B2 * | 5/2007 | Baker | 187/247 |

FOREIGN PATENT DOCUMENTS

| | | | |
|---|---|---|---|
| CH | 407 472 | A | 2/1966 |
| GB | 2 082 795 | A | 3/1982 |
| WO | WO 92/19527 | A1 | 11/1992 |
| WO | WO 98/31183 | A1 | 7/1998 |

* cited by examiner

*Primary Examiner*—James Keenan
(74) *Attorney, Agent, or Firm*—Harness, Dickey & Pierce

(57) ABSTRACT

A system is for lifting and lowering an object, such as a vehicle. Such a system includes at least two mobile lifting columns with: a displaceable frame with a standing mast part; a carrier displaceable along the mast part for engaging the object to be lifted; a drive for moving the carrier along the mast part; a control for controlling at least the drive; and communication devices for communicating with at least other lifting columns in the group via a transmission or broadcast path. Further, at least one of the lifting columns in the group includes a selectively user operable selection device for, when actuated, selecting any of the lifting columns from the group for a sub-group. As such, a higher degree of flexibility is provided.

13 Claims, 2 Drawing Sheets

SYSTEM WITH LIFTING COLUMNS

This application is the national phase under 35 U.S.C. § 371 of PCT International Application No. PCT/NL2003/000638 which has an International filing date of Sep. 15, 2003, which designated the United States of America and which claims priority on Netherlands Patent Application number NL 1021448 filed Sep. 13, 2002, the entire contents of which are hereby incorporated herein by reference.

FIELD OF THE INVENTION

The present invention generally relates to a system with lifting columns for lifting and lowering an object, such as a vehicle, and more particularly a car, bus, truck or the like.

BACKGROUND OF THE INVENTION

In the systems, that are known from e.g. U.S. Pat. No. 6,315,079, the lifting columns are disposed displaceably on a workshop floor, and over the workshop floor are arranged the cables that are required for electric power supply to the drive and control of the lifting columns, as well as conductors for mutual contact between the controls of the individual lifting columns.

Therein, an energy source such as wall sockets have to be available at the workshop floor. Also, the cables from, to and between the lifting columns are often in the way on the workshop floor, wherein people can trip over them, which can cause a hazardous situation. Further, when the setup or configuration of the individual lifting columns has to be changed, all cabling has to be disconnected, where-after the lifting columns can be displaced to the desired positions thereof, followed by reconnection of all cables for energy supply and for mutual contact.

The couplings can be damaged as a result of frequent disconnection of the cabling for a new setup or because of the danger of someone stumbling over the cables and thereby disconnecting the cables, after which the cables have to be replaced and work on the workshop floor has to be interrupted until new cables are in place. When couplings are damaged or couplings which have merely been pulled out, failure of the system could occur which could then in turn result in a hazardous situation for the users of the system. The position of a lifting column in the known system is, through physical connection thereof with a socket, determined by the identification or address of the socket, rather than the lifting column itself.

Such systems are also known from for example WO 92/19.527, wherein radiographic communication means can be employed. Such communication can remedy some of the drawbacks mentioned above, but the disclosure of this document is restricted to deployment of a single fixed group of columns, and communication can, in use of the system for lifting objects, be useful in said use. However, prior to or in the course of this use, the system requires set-up or re-configuration of the individual lifting columns in the system, as noted above.

Without the sockets of a cable based system, assigning an address or identification to a desired one of the lifting columns is a severe problem, that is according to the disclosure of WO 92/19.527 avoided with a system comprising a group of a fixed number of predetermined lifting columns. However, for many applications more flexibility is desired, for instance when adding or removing lifting columns to or from a subgroup, that is actually used for lifting different objects, such as vehicles of varying size.

SUMMARY OF THE INVENTION

The present invention has for its object to provide a much more flexible system, for which purpose there is provided a system for lifting and lowering an object.

An unambiguous selection can thus be made in very specific manner for each specific lifting column or those lifting columns into a sub-group—which could be as large as the entire group, but is usually smaller—that are required for lifting and lowering the object to be lifted. It is possible with such a system according to the invention to freely select lifting columns for a sub-group having therein a number of lifting columns which suffices to handle an object for lifting and lowering, in particular a vehicle, in the desired manner. The other lifting columns are then out of use or can be employed in or assigned to an additional sub-group for special functions, such as engaging the wheels on a wheel axle which has to be disassembled, wherein the lifting columns in the sub-group for engaging these wheels on this wheel axle are lowered sooner, after disassembly or disconnection of the relevant wheel axle, than the other lifting columns which must then still support the rest of the vehicle or object.

The lifting columns in a sub-group are preselected (prior to handling a vehicle or object). Use can be made for this purpose of a master column which can be chosen at random from the available group of lifting columns, or a predetermined number of master columns, which are identifiable as such, can be provided in the system. The other lifting columns of the group can then be designated as slave columns. In one embodiment with identifiable predetermined master columns, the number of sub-groups is determined by the number of master columns. In other embodiments, wherein a lifting column to be chosen at random from the group can be used as master column, as many sub-groups can be formed as there are lifting columns in the group, or the sub-group can include all lifting columns of the group itself. It will be apparent that a high degree of flexibility can be hereby achieved.

In a system according to the invention, communications in the system are, at least during selection of said at least one lifting column for the sub-group, based on master-slave principles, and a selected lifting column, being the first selected column for a sub-group, is as a result of first selection thereof a master lifting column. In such a configuration the selection process takes place during set-up or re-configuration of the system. By ensuring that the first selected lifting column will be the master in the subsequent communications for set-up or re-configuration, the subsequent steps in the process can to a large extent be automated.

Also, since in such a system usually more than one slave is employed, starting the selection process with the master is convenient and reduces complexity thereafter. The other lifting columns are then automatically, upon their selection, slaves and will identify themselves as such, and their availability for selection, to the master. The order in which the remaining lifting columns, that are required for the sub-group and the application of that sub-group, sign-on to the sub-group in general, and identify themselves to the master, can favourably be employed to also assign an address to these lifting columns.

In a system according to the invention, at least one slave column, being a slave column during at least selection, can comprise operating means for combined actuation of the lifting columns in the sub-group of selected lifting columns in operation during lifting of the object. In this use the system can continue to employ the master-slave principles of communication, but could also switch to a multi-master principle, wherein all lifting columns in the sub-group can transmit or broadcast lifting or lowering commands to the other columns in the sub-group.

So as to reduce still further the need for cables, the system can comprise wireless, such as radiographic, communication means for contact with the control of the lifting column.

The selection means of a selected master column are preferably adapted to transmit a delete signal, at the beginning of a new selection of at least one slave column, to at least that lifting column or those lifting columns which was or were selected with the relevant master column in a sub-group at an earlier stage, in order to cancel the previous selection thereof. In this way a lifting column which has functioned earlier with the relevant master column in a sub-group is prevented from continuing to respond to lifting instructions in a new sub-group with this—or any other—master column therein.

A variety of options is available for selection of lifting columns from the group for the purpose of forming the sub-group with the master column therein. The selection means of the master column can give a user an indication of each lifting column available for selection in the sub-group, and comprise associated selectors for the actual selection of lifting columns for the sub-group to be selected as slave columns.

Another option is that the selection means of a slave column are adapted to read an identification for the purpose of selecting this slave column in a sub-group associated with the master column.

In the first case selection of lifting columns for the sub-group is possible from the master column, while in the alternative it is necessary to walk round the desired slave columns is required for selection thereof in the sub-group.

In an embodiment with selection at the slave column, the identification can be read from an identification card associated with the master column. The lifting columns in a sub-group are hereby prevented from responding during selection or during operation to the wrong master column or to the master column with which the lifting columns have been selected at an earlier stage in a sub-group. The identification can then be per se a designation of the master column itself, or the association of the master column and the lifting columns to be selected as slave columns can be based on an identification of the said identification card. In this latter case a random number can be generated on the identification card, for instance by the master column or by an external component of the system that is not a lifting column, although such an identification does not necessarily have to be random and can for instance be a designation of date and time, which therefore immediately provides a piece of information about the moment in time from which the system with the selected sub-groups has functioned in the configuration valid at a particular moment.

An indicator is hereby also obtained as to when previous settings have lapsed.

The present invention not only relate to a system for lifting, which is essentially to be set-up, configurable or re-configurable in the above described manner, but also to a method underlying the set-up, configuration and re-configuration of the system.

BRIEF DESCRIPTION OF THE DRAWINGS

The invention will be described hereinbelow, for a better understanding thereof, on the basis of embodiments shown in the annexed drawings, in which the same and/or similar parts and components are designated with the same reference, and wherein it is noted that the present invention is not limited to these explicit embodiments. In the drawings.

DETAILED DESCRIPTION OF THE EXAMPLE EMBODIMENTS

Figure 1:
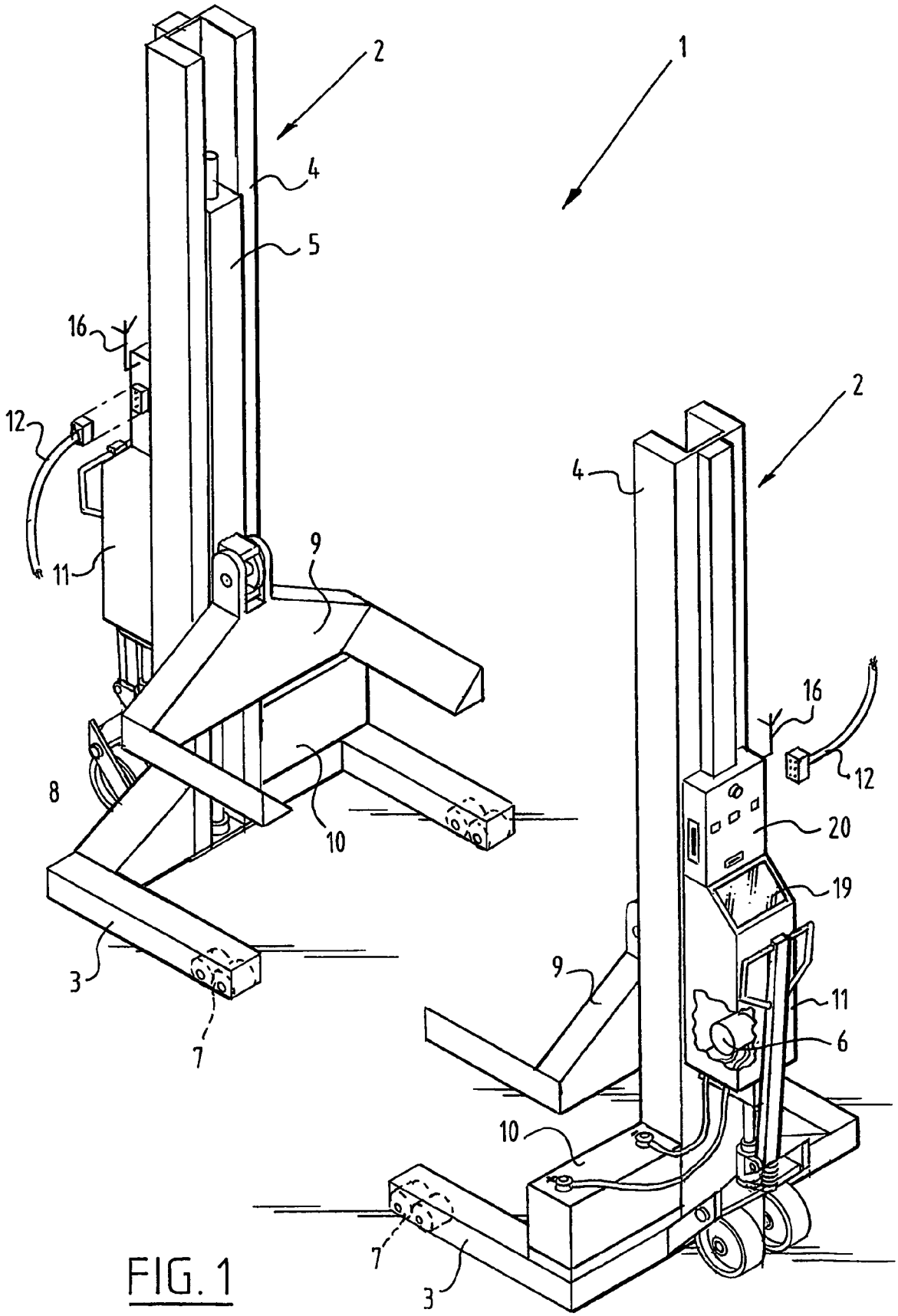
FIG. 1 shows a perspective view of a first embodiment of a system according to the present invention.

FIG. 1 shows a system 1 according to the present invention which comprises two lifting columns 2. Each of the lifting columns is provided with a foot 3 and a mast part 4, wherein a carriage 5 is movable up and downward along mast part 4 under the influence of a drive in the form of a motor 6.

Foot 3 and mast part 4 thus form a kind of frame which can travel over rollers 7 and wheels 8. Wheels 8 can be raised per se along the frame, whereby the foot comes to lie on the ground and there is no danger of the lifting column 2 being able to move away while it is bearing a load.

Arranged on carriage 5 is a carrier 9 which is designed to engage for instance a wheel of a vehicle (not shown).

As already noted, movement of carriage 5 and the related carrier 9 is caused by a motor 6, in particular an electric motor, which is provided with electric power by a battery 10. Battery 10 is a source of energy not only for electric motor 6, but also for a control (not shown) accommodated in a control box 11. The control is usually formed from a microprocessor and a memory co-acting therewith and loaded with a control program. The controls in control boxes 11 control the operation of electric motor 6, and are also mutually connected for this purpose by means of a relatively light cable 12. An additional cable (not shown) can be used to charge batteries 10 when the lifting columns are not in use.

The system 1 shown in FIG. 1 as embodiment of the present invention is of the multi-master type. This means that lifting instructions can be entered for both of the lifting columns 2 shown in FIG. 1 by inputting the instructions on a control panel 20. The term "multi-master" is furthermore understood to mean that such lifting instructions can be inputted at either of the two lifting columns.

Figure 2:
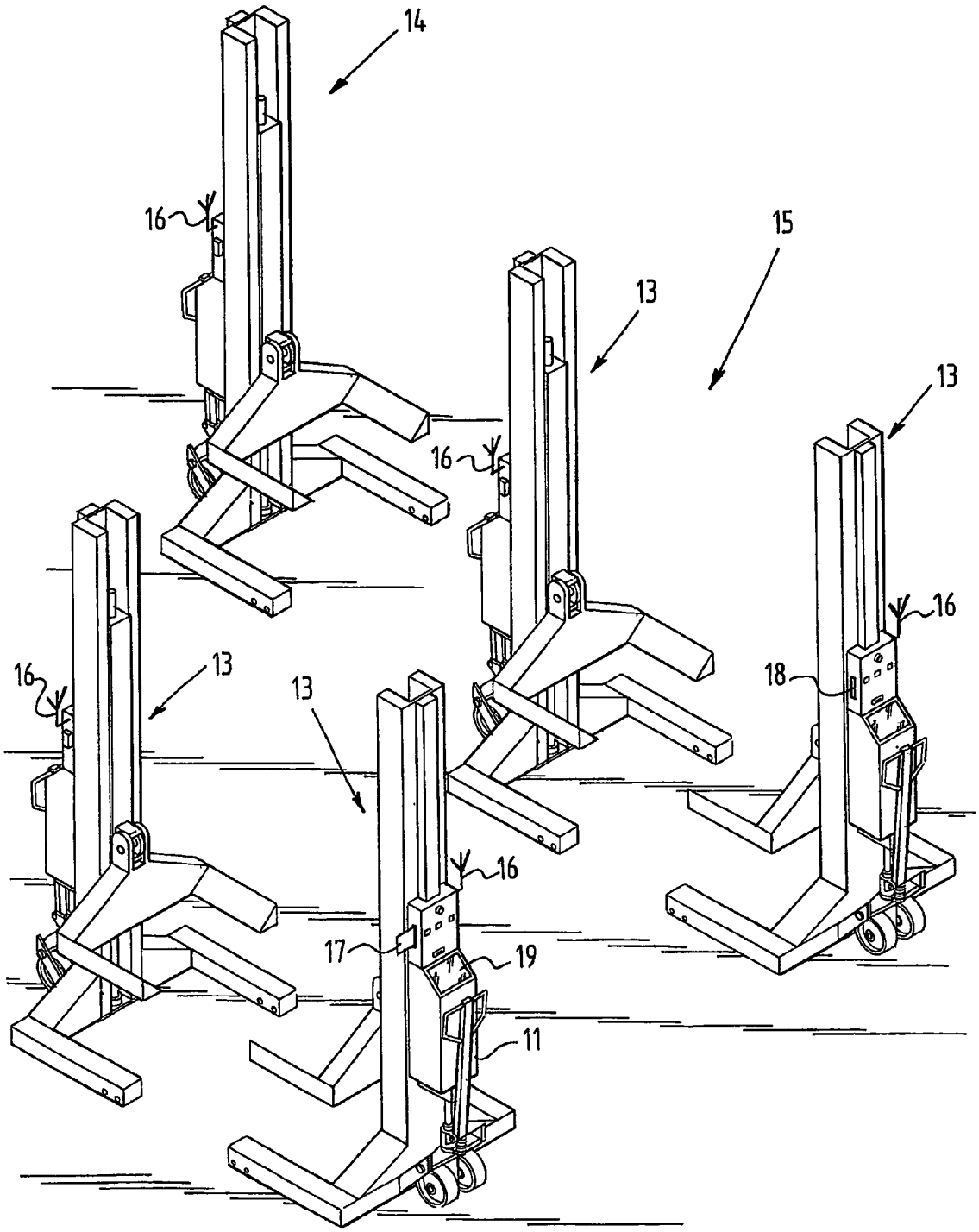
FIG. 2 shows a perspective view of a second embodiment of a system according to the present invention.

FIG. 2 shows a system according to the present invention in another embodiment thereof. The system comprises a group of five lifting columns, i.e. a first sub-group 15 having therein four lifting columns 13, and a further lifting column 14 which forms a second sub-group itself or together with another lifting column (not shown). The options for subdividing the lifting columns 13, 14 into sub-groups will be further described below.

Lifting columns 13 of sub-group 15 and lifting column 14 are all equipped with an antenna 16 as radiographic communication means for mutual contact. The lifting columns 13 of sub-group 15 are in any case in contact with each other for the purpose of executing a lifting operation to be performed by this sub-group 15 on an object for lifting and lowering, in particular a vehicle. This latter during operation of the system when the group of lifting columns 13, 14 is already subdivided into sub-groups, wherein lifting columns 13 in sub-group 15 have a first combined action, and the lifting column 14 or lifting columns in the second, not explicitly designated sub-group jointly perform no operation or another one.

The system in the embodiment shown in FIG. 2 preferably also has lifting columns 13, 14 based on the multi-master type. Each of the lifting columns 13 in sub-group 15 can herein be used during operation as master for inputting lifting instructions during the actual lifting or lowering of objects. Prior to such an operation the lifting columns 13, 14 therefore have to be subdivided into sub-group 15 and the additional, further non-designated sub-group having therein lifting column 14.

This can be brought about in a number of different ways, for which purpose lifting columns 13, 14 are equipped with selection means now to be described hereinbelow.

As a possible non-limitative embodiment, an embodiment will first be described below wherein the selection procedure to subdivide the lifting columns into sub-groups is based on a master-slave principle during the process of selection. The foremost lifting column 13 of sub-group 15 in the drawing is herein used temporarily, i.e. during the selection process, as master. At the beginning of the selection process the lifting column 13 functioning as master sends a signal via antenna 16 to all the other lifting columns 13, 14, or in any case to those lifting columns which have been subdivided at an earlier stage in a sub-group with the relevant lifting column 13 functioning as master, that this previous subdivision has been cancelled. This is therefore a delete signal transmitted by the lifting column 13 functioning as master.

An identification card 17 is herein inserted into a card holder 18 of the relevant lifting column 13. The lifting column 13 which has in card holder 18 the card 17 used to transmit the delete signal is always the lifting column 13 of the master type, or can be designated as such due to the presence of card 17 in card holder 18 thereof. In this latter case any of the lifting columns 13, 14 can be used as lifting column of the master type during setting of the subdivision into sub-groups.

After transmitting of the delete signal, all lifting columns 13, 14 are available for use as lifting columns of the slave type. These are selectively actuated by inserting card 17 in the card holder 18 of these other potential lifting columns 13, 14 of the slave type. This is an operation which must be carried out be a user. When card 17 is inserted into a card holder 18 of any of the other lifting columns, this is actuated as lifting column of the slave type in order to transmit a sign-on signal, via antenna 16, to the lifting column 13 of the master type.

The sequence in which lifting columns 13, 14 of the slave type sign on to the foremost lifting column 13 of the master type in FIG. 2 can be used to identify them individually and in relation to each other. Thus is prevented that any lifting column potentially functioning as lifting column of the slave type has to have a unique identification.

During operation, i.e. during the actual lifting and lowering of objects, this identification based on the order of signing-on can be used to distribute and direct lifting instructions to in any case the lifting columns forming part of sub-group 15.

The selection process is closed when the identification card 17 is again inserted into the lifting column 13 functioning as master column, in this case the foremost lifting column 13 in FIG. 2.

The same process can be completed for an additional sub-group of the group of lifting columns, of which lifting column 14 for instance can then also form part, for instance as lifting column of the master type, together with other lifting columns (not shown).

That the foregoing description of specific embodiments of systems according to the present invention must not be deemed as limitation of this invention will be apparent from that fact that many alternative and additional embodiments are possible, all of which lie within the scope of protection as defined in the appended claims. It is thus possible to use a display element, such as a screen 19, to display all lifting columns 13, 14 which are available for selection to a sub-group. Through input via operating means (not shown) such as selectors, it is then possible to select specific lifting columns displayed on screen 19 to the sub-group by transmitting thereto a selection signal via an antenna 16 from a lifting column functioning as master column.

A lifting column 13, 14 to be selected will then, if it is functioning correctly, send back a confirmation signal. The need for an identification card can herein be dispensed with, although a universal, unique identification number will in all likelihood have to be assigned to each lifting column. It is however also conceivable for such universal, unique identification numbers not having to be necessary if temporary identification numbers are assigned during the selection process. Random identifiers other than numbers can also be applied.

It is also noted that in the case of an error, such as an error where it has been possible for a dangerous situation to occur, for instance a drop in voltage in one of the columns to below a predetermined level, it is deemed necessary to reset the subdivision of the lifting columns of the group into newly defined sub-groups. Other safety measures can herein also be implemented.

In embodiments where temporary identifications are used, it may be extremely useful to include therein information about the date and time of the selection, because information is hereby provided about the period of time for which a subdivision has been employed or from when an old subdivision should have been deleted.

It is also possible to use the subdivision and the individual associated lifting columns in a key for the purpose of identifying each lifting column. A first sub-group is then designated for instance as I, while a second sub-group is II and so on. The individual lifting columns 13 forming part of a determined sub-group 15 can then be identified within the group in order of signing-on or in random other manner.

The invention claimed is:

1. System for lifting and lowering an object, comprising a group of at least two mobile lifting columns, each lifting column comprising:

a displaceable frame with a standing mast part;

a carrier displaceable along the mast part for engaging the object to be lifted;

a drive for moving the carrier along the mast part;

a control for controlling at least the drive; and communication means for communicating with at least other lifting columns in the group via a transmission or broadcast path, wherein selection of at least one of the lifting columns of the group is based on master-slave principles wherein selection of any column as a first lifting column for a first sub-group is, as a result of the first selection a first master lifting column, the first selected column configured to actuate selectively operable selection means for any of the remaining column or columns from the group to be included in the first sub-group, the selection of any remaining column or columns being a slave column or columns wherein the selection means of a slave column is adapted to read and adopt an identification, upon selection to the first sub-group, for the purpose of selecting the slave column in the first sub-group associated with the first master column, and for thereafter addressing the slave column in the process of lifting the object, wherein the identification is readable from an identification component associated with the first master column, wherein the system is configured to allow for the selection of an additional master column or columns, and an additional slave column or columns, to form a plurality of additional sub-groups with remaining columns that were not assigned to the first sub-group.

2. System according to claim 1, wherein at least one slave column, being a slave column during at least selection, comprises operating means for combined actuation of the lifting columns in the first sub-group of selected lifting columns in operation during lifting of the object.

3. System according to claim 2, wherein the communication means are of a wireless type for controlling the lifting column.

4. System as claimed in claim 3, wherein the selection means of the first master column are adapted to transmit a delete signal, at the beginning of the selection process, to at least one other lifting column or to at least one lifting column selected at an earlier stage with the relevant master column in a sub-group, in order to cancel the previous selection thereof.

5. System as claimed in claim 2, wherein the selection means of the first master column are adapted to transmit a delete signal, at the beginning of the selection process, to at least one other lifting column or to at least one lifting column selected at an earlier stage with the relevant master column in a sub-group, in order to cancel the previous selection thereof.

6. System as claimed in claim 1, wherein the selection means of the first master column are adapted to transmit a delete signal, at the beginning of the selection process, to at least one other lifting column or to at least one lifting column selected at an earlier stage with the relevant master column in a sub-group, in order to cancel the previous selection thereof.

7. System as claimed in claim 6, wherein the selection means of the first master column gives to a user an indication of each lifting column available for selection in the first sub-group, and comprise associated selectors for selecting lifting columns for the first sub-group to be selected as slave columns.

8. System as claimed in claim 1, wherein the identification component is a tangible identification card.

9. System as claimed in claim 8, wherein the identification is a designation of the first master column, an identification of the identification card, a random number generated for instance by the first master column or a date and time designation generated by the system.

10. System as claimed in claim 1, wherein the identification includes at least one of a designation of the first master column, an identification of the identification component, a random number generated for instance by the first master column, and a date and time designation generated by the system.

11. Method of selecting at least one lifting column in a system for lifting and lowering an object, the system comprising a group of at least two mobile lifting columns, each lifting column comprising: a displaceable frame with a standing mast part; a carrier displaceable along the mast part for engaging the object to be lifted; a drive for moving the carrier along the mast part; a control for controlling at least the drive; and communication means communicating with at least other lifting columns in the group via a transmission or broadcast path, the method comprising:

selecting at least one of the lifting columns in the group for a first sub-group; and communicating between selected columns on the basis of master-slave principles, wherein a first lifting column is initially selected as a first master lifting column for the first sub-group, wherein a selection of any remaining column includes reading and adopting an identification, upon selection to the first sub-group, for the purpose of selecting the any remaining column as a slave column in the first sub-group associated with the first master column, and for thereafter addressing the slave column in the process of lifting the object, wherein reading the identification is performed from an identification component associated with the first master column selecting an additional master column or columns, and an additional slave column or columns, to form a plurality of additional sub-groups with remaining columns that were not assigned to the first sub-group.

12. Method of claim 11, wherein the identification component is an identification card.

13. Method as claimed in claim 11, wherein the identification includes at least one of a designation of the first master column, an identification of the identification component, a random number generated for instance by the first master column, and a date and time designation generated by the system.

* * * * *